United States Patent [19]

Szabo et al.

[11] 4,378,876

[45] Apr. 5, 1983

[54] DISPLAY COIN HOLDER ASSEMBLIES

[76] Inventors: Bela G. Szabo, 109 Park Rd., Rosslyn Farms, Carnegie, Pa. 15106; Dean J. Hirschfield, 261 Trotwood Dr., Pittsburgh, Pa. 15241

[21] Appl. No.: 291,085

[22] Filed: Aug. 7, 1981

[51] Int. Cl.[3] ..... B65D 25/10

[52] U.S. Cl. ..... 206/45.34; 206/0.82

[58] Field of Search ..... 206/0.82, 0.83, 0.84, 206/45.34, 306, 18; 229/92.9

[56] References Cited

U.S. PATENT DOCUMENTS

| | | | |
|---|---|---|---|
| 746,848 | 12/1903 | Klumpp | 206/18 |
| 2,389,312 | 11/1945 | Honza | 206/0.82 |
| 2,985,284 | 5/1961 | Levy | 206/0.83 |
| 3,283,894 | 11/1966 | Hafner et al. | 206/306 |
| 3,532,213 | 10/1970 | Schulz | 206/18 |
| 3,788,464 | 1/1974 | Skinner | 206/0.82 |
| 4,320,831 | 3/1982 | Szabo et al. | 206/45.34 |

FOREIGN PATENT DOCUMENTS

| | | | |
|---|---|---|---|
| 2653234 | 9/1977 | Fed. Rep. of Germany | 206/3 |

*Primary Examiner*—William T. Dixson, Jr.
*Assistant Examiner*—Brenda J. Ehrhardt
*Attorney, Agent, or Firm*—Samuel Lebowitz

[57] ABSTRACT

A holder of molded plastic material for retaining a coin or medallion in centrally spaced relation from the walls of a square perimetric frame by means of four equally spaced slightly curved resilient projections extending inwardly from the walls. The projections are molded integrally with the walls of rectangular section, and are of the same height as the latter. The thickness of the projections diminish from their junctions with the walls, and the rectangular cross-sections thereof diminish correspondingly towards their ends. The resulting flexibility of the projections makes possible the pressing thereof against the periphery of a small coin or medallion. The lengths of the projections may be varied so that when they are short, the outer ends thereof are pressed against the peripheral wall of a coin at uniformly displaced points. A holder with longer projections permits the retention of a coin of smaller size by the yieldable convex edges of the projections against spaced points of the periphery. The holders of the invention securely embrace coins or medallions to permit the close inspection thereof, and may form permanent or detachable inserts in transparent plastic containers for displaying and shipping valuable items such as gems, coins, medallions and the like.

6 Claims, 7 Drawing Figures

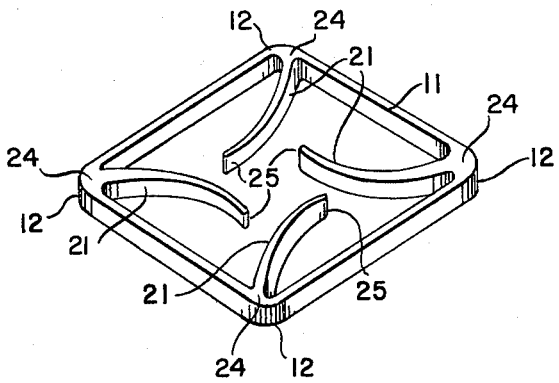
FIG. 4
FIG. 3
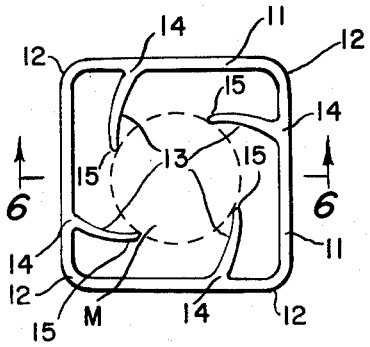
FIG. 5
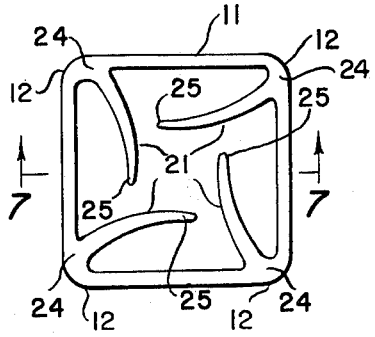
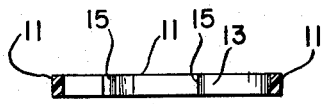
FIG. 6
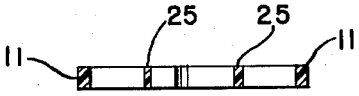
FIG. 7

DISPLAY COIN HOLDER ASSEMBLIES

This invention relates to a display or shipping container for small valuable disk-like objects such as coins, medallions and the like.

It is the object of the present invention to provide an attractive and economical shipping and display unit of transparent plastic material which may be used for displaying effectively the opposite faces and peripheral edges of medallions, coins and the like, and which may be examined without touching or harming the latter, if such is desired.

It is another object of the invention to provide a valuable adjunct to plastic containers for small valuable articles as disclosed in our earlier application, Ser. No. 165,041, filed July 1, 1980, now U.S. Pat. No. 4,320,831 to enhance the utility and versatility of the latter.

It is another object of the invention to provide low-cost molded plastic retainers for valuable disk-like objects which may be easily adapted for the retention of the latter of different sizes and which may be used in containers of different designs.

Other objects and purposes will appear from the detailed description of the invention following hereinafter, taken in conjunction with the accompanying drawings, wherein FIG. 1 is a perspective view of the plastic container for coins, medallions and the like, incorporating therein the holder in accordance with the instant invention;

FIG. 3 is a plan view of the detachable holder for the disk-like object for embracing a coin or medallion of large size;

FIG. 4 is a perspective view of another embodiment of the invention designed for retaining a coin or medallion of small size;

FIG. 5 is a plan view of the insert shown in FIG. 4;

FIG. 6 is a vertical sectional view along line 6—6 of FIG. 3; and

FIG. 7 is a vertical sectional view along line 7—7 of FIG. 5.

Figure 1:
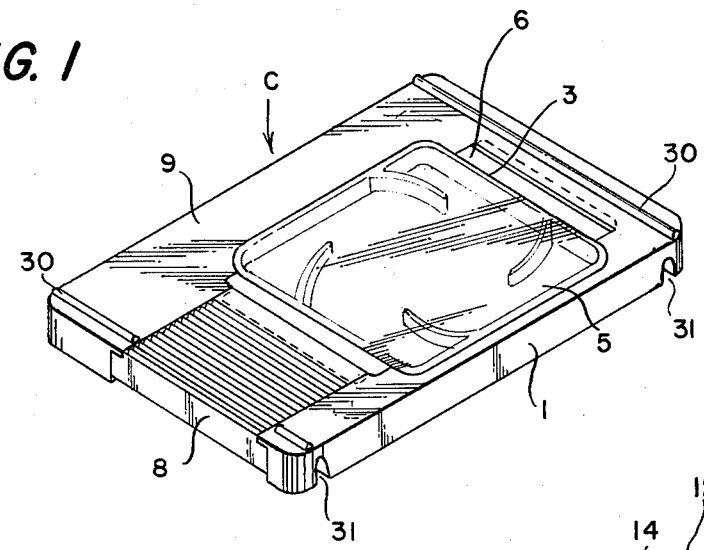
Figure 2:
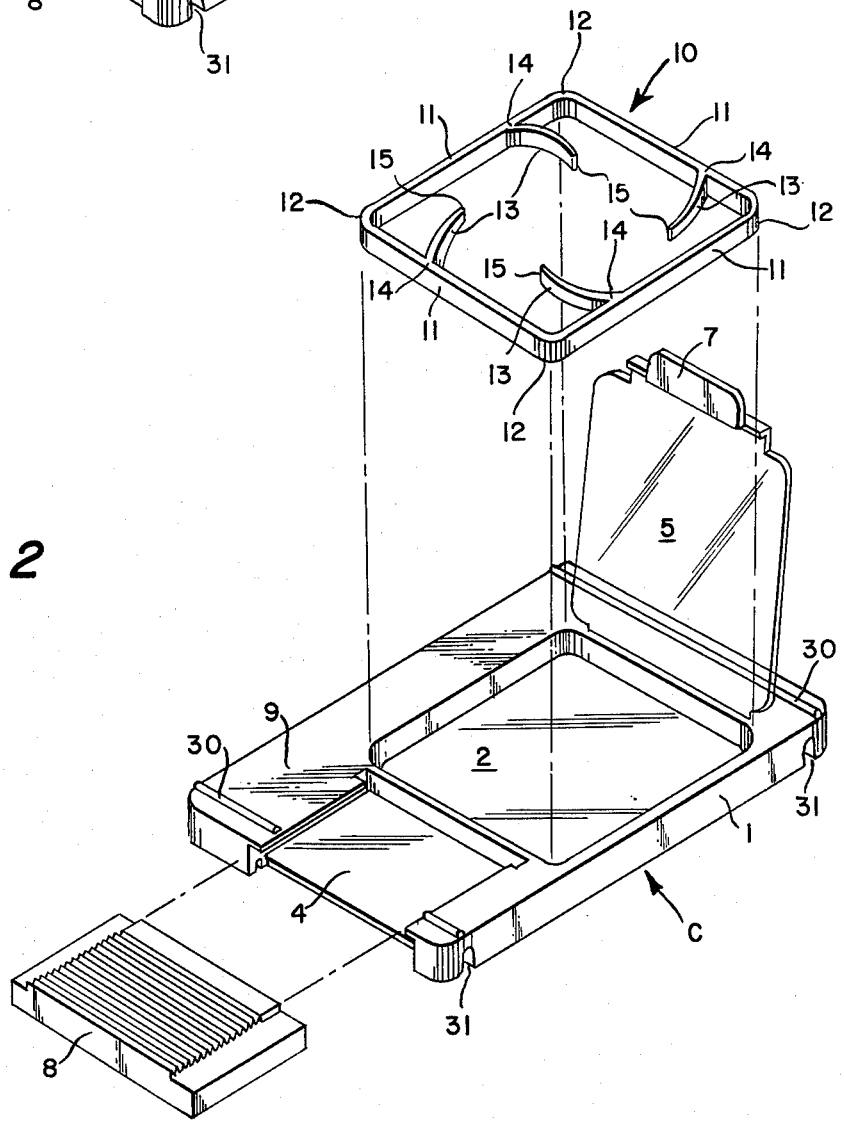
FIG. 2 is an exploded perspective view showing the components of the assembly in FIG. 1, in separated position.

In FIGS. 1 and 2 of the drawings is shown a plastic container for small valuable articles such as jewels, valuable coins, medallions and the like, details of which are disclosed in our above-mentioned U.S. Pat. No. 4,320,831, now U.S. Pat. No. 4,320,831, which is made of reference hereby.

Such molded containers C of rigid plastic material are comprised of three components—a recessed base, a detachably hinged cover and a locking slide for the latter.

The base 1 is provided with a recess 2 designed to acommodate valuable items such as precious gems, coins and the like, for display and shipment. A slot 3 is provided at one end of the base and a lowered shelf 4 at the opposite end thereof. A detachable cover 5, of transparent plastic material has a flange 6 at one end thereof and a finger-hold 7 at the opposite end thereof. The flange 6 is adapted to penetrate the slot 3 in the base to permit hinged movement of the cover 5 relative to the base as well as for complete detachment therefrom. The finger-hold or flap 7 overlies the shelf 4 adjacent to the recess 2, and is designed to be locked in this position by the detachable locking slide 8, the inner end of which may be superposed above the flap 7 to prevent accidental lifting of the cover.

The assembly may be securely locked for shipment by sealing the cover to the base by applying dabs of plastic solvents at the meeting edges, the breakage of which seal would be indicative of tampering with the contents of the container. Also, the locking member 8 for the cover may assume different forms, for example, it may be a rotary type tab permanently attached to the shelf 4.

The upper face 9 of the container, beyond the storage space for the valuable contents and the locking slide, may be used for indicia strips to identify the contents.

Indexing means for stacking the containers are provided by ridges 30 on the top of the container cooperating with recesses 31 at the bottom thereof.

All of the structural features described above are disclosed in the above-mentioned U.S. Pat. No. 4,320,831, and are incorporated herein by reference to said application.

The present invention is concerned with holders for valuable disk-like objects such as coins, medallions and the like, which may be part of the assemblies such as described above, or which may be used independently in containers of other types, as disclosed in U.S. Pat. Nos. 2,389,312, Nov. 20, 1945, and 2,985,284, May 23, 1961.

Two embodiments of the invention are disclosed herein which permit the retention of either coins or medallions of small size or larger size.

The holders in accordance with the invention make possible an examination of the coins or other items either while they are in the container for the holder, or separated therefrom, and permits such examination without the object being touched, if such might prove harmful thereto.

As shown in FIG. 2, the recess 2 in the container is of sufficient size to accommodate the holder 10 which may be fixed within the recess or which may be detachable therefrom. The holder is of square outline, having thin walls 11 with rounded corners 12. Projections or tongues 13 are molded integrally with the walls of the perimetric frame and the junctions 14 between the tongues and the walls are displaced from the corners, as shown in FIGS. 2 and 3. The tongues are of flexible plastic and are of substantially uniform length with a height corresponding to the height of the walls 11 of square frame 10. The tongues are curved along their length and have a diminishing cross-section from their junction points 14 to their free terminal ends 15. The yeildability of the tongues permit the grasping of coins of varying sizes ranging from $\frac{7}{8}''$ to $1\frac{3}{8}''$ in diameter, and because of the equidistantly spaced points of retention of the periphery of the coin, the opposite faces and periphery of the coin may be inspected closely without touching the same. The holding frame may be of transparent plastic as is the container C.

A second embodiment of the holder 10 is shown in FIGS. 4, 5 and 7. In this case the tongues 21 are joined to the walls 11 at their internal corners 12. The curved fingers 21 are longer than fingers 13 in the embodiment described above. They extend from the junctions 24 at the corners, and the convex portions thereof between the junctions and free ends 25 are adapted to contact small coins and medallions which may range in size from 7/16" to $\frac{7}{8}''$. These are also of rectangular section diminishing from points 24 to 25, and of the same height as walls 11.

The alternative use of the inserts described above, are adequate to accommodate nearly all known gold coins and medallions.

Items measuring $1\frac{3}{8}''$ to $1\frac{1}{2}''$ in size, which may be round, hexagonal or rectangular in form, require no holder insert and these may be seated in the recess 2 of the container with or without a liner of decorative fabric. The latter is also used when the plastic container C is used for the packaging and display of precious stones, pearls, etc., in which case the color of the fabric is varied to accentuate the color of the specific gems enclosed therein.

While the holders described above are particularly adapted to retain valuable objects M having circular peripheries, they may serve to hold items of other geometric outlines, such as pentagonal, hexagonal or octagonal medallions.

We claim:

1. A display or shipping box of transparent plastic material, for a small valuable disk-like object, comprising (a) a base having a substantially square recess in the upper surface thereof for seating the disk-like object therein, (b) a cover for said base overlying said recess, (c) a substantially square insert of molded plastic material with rounded corners, said insert having thin boundary walls and an external perimetrical outline conforming to the boundaries of said recess, and (d) four thin integral yieldable tongues projecting inwardly from said boundary walls and spaced equidistantly therein relative to the corners of the insert, for resilient engagement with the periphery of said object at a pluraity of equidistant points, said tongues being of uniform length, and of a height conforming to the height of said boundary walls, curved along their length, and of rectangular cross-section diminishing from the junctions with said walls.

2. A device as set forth in claim 1, wherein said tongues are less than half the length of said walls, and the junctions therebetween are displaced an equal distance from the respective internal corners of the insert, so that the free ends of the tongues are adapted to embrace an object of relatively large dimension.

3. A device as set forth in claim 1, wherein said tongues are more than half the length of said walls, and the junctions therebetween are at the internal corners of the insert, so that the intermediate convex portions of the tongues are adapted to embrace an object of relatively small dimension.

4. A holder for a small valuable disk-like object comprising (a) a square frame of substantially rigid molded plastic material, constituted by four thin boundary walls with rounded corners, said walls and corners being of rectangular cross-section, and (b) four thin integral yieldable tongues projecting inwardly from said boundary walls and spaced equidistantly therein relative to the corners of said frame, for resilient engagement with the periphery of said object at a plurality of equidistant points, said tongues being of uniform length, and of a height conforming to the height of said boundary walls, curved along their length, and of rectangular cross-section diminishing from the junctions with said walls.

5. A device as set forth in claim 4, wherein said tongues are less than half the length of said walls, and the junctions therebetween are displaced an equal distance from the respective internal corners of the frame, so that the free ends of the tongues are adapted to embrace an object of relatively large dimension.

6. A device as set forth in claim 4, wherein said tongues are more than half the length of said walls, and the junctions therebetween are at the internal corners of the frame, so that the intermediate convex portions of the tongues are adapted to embrace an object of relatively small dimension.

* * * * *